US007373789B2

(12) United States Patent
Oh et al.

(10) Patent No.: US 7,373,789 B2
(45) Date of Patent: May 20, 2008

(54) REFRIGERATOR AND ICE MAKING APPARATUS

(75) Inventors: Seung Hwan Oh, Gunpo-si (KR); Myung Ryul Lee, Seongnam-si (KR)

(73) Assignee: LG Electronics Inc., Seoul (KR)

( * ) Notice: Subject to any disclaimer, the term of this patent is extended or adjusted under 35 U.S.C. 154(b) by 317 days.

(21) Appl. No.: 11/212,667

(22) Filed: Aug. 29, 2005

(65) Prior Publication Data

US 2006/0283202 A1 Dec. 21, 2006

(30) Foreign Application Priority Data

Jun. 17, 2005 (KR) ..... 10-2005-0052400

(51) Int. Cl.
*F25C 5/04* (2006.01)

(52) U.S. Cl. ..... 62/320; 62/344; 241/DIG. 17

(58) Field of Classification Search ..... 62/344, 62/320; 222/413; 241/DIG. 17
See application file for complete search history.

(56) References Cited

U.S. PATENT DOCUMENTS 5,105,631 A 4/1992 Watanabe et al.
6,973,802 B1 * 12/2005 Seo et al. ..... 62/320
7,065,975 B1 * 6/2006 Herndon et al. ..... 62/66

FOREIGN PATENT DOCUMENTS

KR 10-2005-0028227 A 3/2005

* cited by examiner

*Primary Examiner*—William E. Tapolcai
(74) *Attorney, Agent, or Firm*—Birch, Stewart, Kolasch & Birch, LLP

(57) ABSTRACT

Refrigerator and an ice maker, the refrigerator including an ice maker, an ice bank for receiving ice from the ice maker, and discharging the ice, an ice moving device movably mounted for receiving ice from the ice bank, and discharging the ice to a dispenser, and a driving device for moving the ice moving device, thereby obtaining ice without bending oneself.

16 Claims, 5 Drawing Sheets

REFRIGERATOR AND ICE MAKING APPARATUS

CROSS-REFERENCE TO RELATED APPLICATION

This application claims the benefit of Korean Application No. P2005-52400, filed on Jun. 17, 2005, which is hereby incorporated by reference as if fully set forth herein.

BACKGROUND OF THE INVENTION

1. Field of the Invention

The present invention relates to a refrigerator and an ice making apparatus from which ice can be taken out without bending oneself.

2. Discussion of the Related Art

In general, the refrigerator stores food at a low temperature by operating a refrigerant system.

In general, the refrigerator is provided with a freezing chamber and a refrigerating chamber. In the refrigerators, there are a bottom freezer type in which the freezing chamber is arranged at a lower portion, and a top freezer type in which the freezing chamber is arranged at an upper portion. In the freezing chamber, there may be an ice making apparatus provided thereto.

Recently, in order to satisfy various tastes of consumers, the ice making apparatus is provided, not only to the refrigerator, but also to various products, such as water purifier. The ice making apparatus is connected to a dispenser for the user to have ice through the dispenser.

However, the related art ice making apparatus, or refrigerator has the following problem.

In the bottom freezer type refrigerator, the dispenser can not but be arranged at the lower portion of a body of the refrigerator, because the ice making appatatus is arranged in the freezing chamber. Moreover, in a case the ice making apparatus is arranged in a refrigerator with a low body height, or the lower portion of a body of a predetermined product, the dispenser can not but be arranged at a lower portion of the body. In this case there is inconvenience of the user to bend oneself for taking out ice.

SUMMARY OF THE INVENTION

Accordingly, the present invention is directed to a refrigerator and an ice making apparatus that substantially obviates one or more problems due to limitations and disadvantages of the related art.

An object of the present invention is to provide a refrigerator and an ice making apparatus, which enables a user to take out ice without bending oneself even in a case the ice making apparatus is arranged at a lower portion of a body of a refrigerator.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a refrigerator includes an ice maker, an ice bank for receiving ice from the ice maker, and discharging the ice therefrom, an ice moving device movably mounted for receiving ice from the ice bank, and discharging the ice to a dispenser, and a driving device for moving the ice moving device.

The ice maker may be arranged at a lower portion of a refrigerator body. Preferably, the refrigerator body has a freezing chamber at the lower portion, and the ice maker is arranged at the freezing chamber. Preferably, the ice bank is arranged at the freezing chamber.

Preferably, the ice bank includes an ice storage case under the ice maker for receiving ice from the ice maker, and an ice conveyer in the ice storage case for discharging ice to the ice moving device.

Preferably, the ice conveyer includes a conveyer motor in the ice storage case for generating driving force, and an ice conveying part rotatably coupled to the conveyer motor for pushing the ice to the ice moving device as the ice conveying part rotates.

Preferably, the ice moving device includes a ice moving case connected to the driving device and received ice from the ice bank, and an ice discharger in the ice moving case, for discharging ice from the ice moving case to a dispenser.

Preferably, the ice discharger includes a discharger motor in the ice moving case for generating driving force, and an ice discharging part rotatably coupled to the discharger motor for discharging ice to the dispenser as the ice discharging part rotates.

In this instance, the refrigerator may further include an ice crusher for crushing ice as the ice crusher is rotated by the ice discharger.

The ice moving device may be a ice moving case connected to the driving device, and designed to receive ice from the ice bank, and to be taken out of the dispenser in a predetermined position.

Preferably, the ice bank has a ice storage capacity greater than the ice moving device.

Preferably, the refrigerator further includes a passage for moving the ice moving device. For example, the passage is disposed vertically in the refrigerator so that the ice moving device moves up/down along the passage.

Preferably, the driving device includes a motor for generating driving force, a pulley rotatable by the motor, and a wire wound on the pulley and connected to the ice moving case.

Preferably, the driving device includes a motor for generating driving force, and a ball screw rotatably coupled to the motor, for moving the ice moving case as the ball screw rotates. For example, the ball screw is disposed vertically in the passage so that the ice moving case moves up/down.

In another aspect of the present invention, an ice making apparatus includes an ice maker; an ice bank for receiving ice from the ice maker, and discharging the ice, an ice moving device movably mounted for receiving ice from the ice bank, and discharging the ice to a dispenser, and a driving device for moving the ice moving device.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
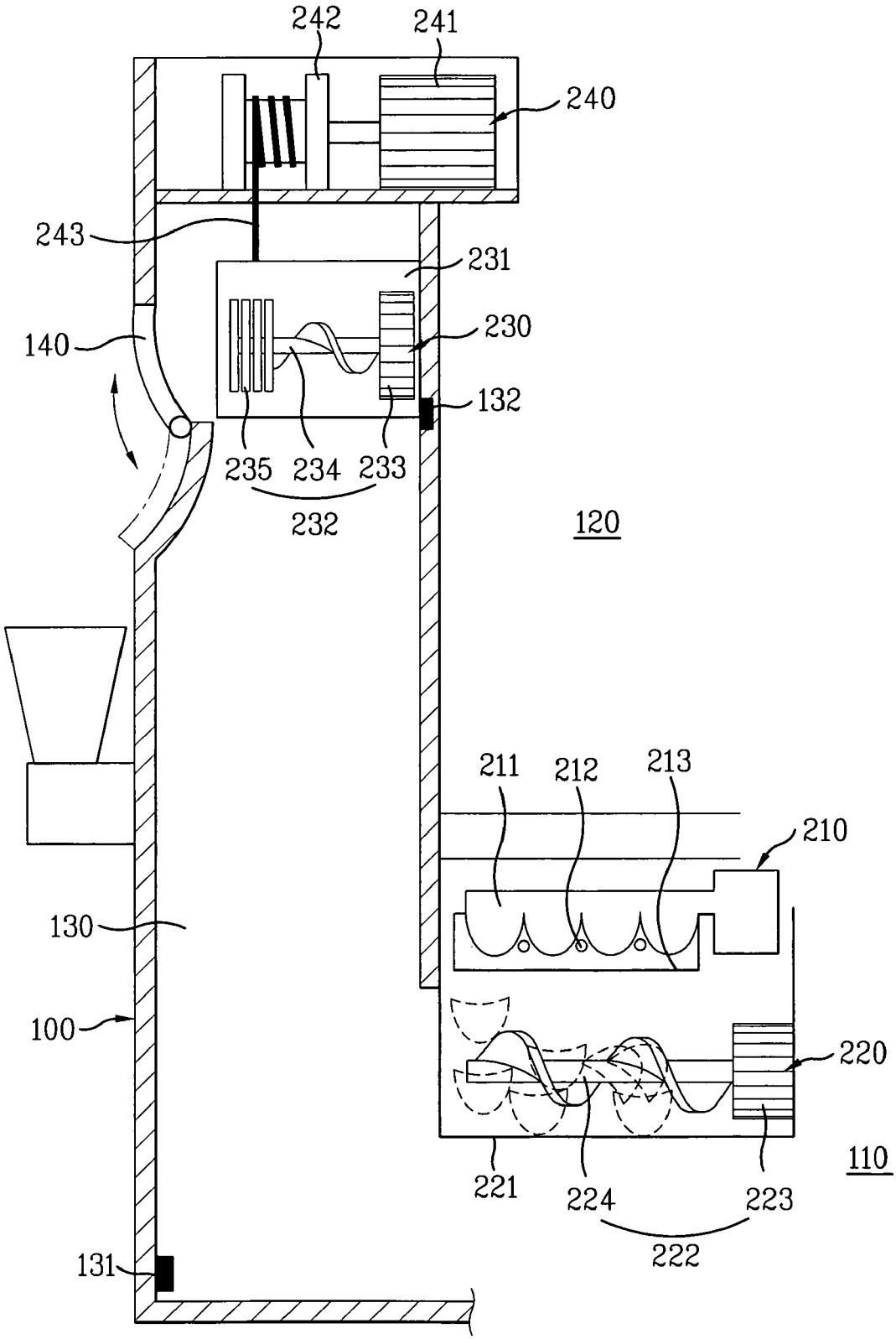
FIG. 1 illustrates a diagram of a refrigerator having an ice maker applied thereto in accordance with a preferred embodiment of the present invention, schematically.

A bottom freezer type refrigerator of the present invention will be described with reference to FIG. 1.

The bottom freezer type refrigerator includes a freezing chamber 110 at a lower portion of a body 100 thereof, and a refrigerating chamber 120 over the freezing chamber 110. There is an ice making apparatus is arranged over the freezing chamber 110 and the refrigerating chamber 120. The ice making apparatus may be arranged a front or a side of the refrigerator.

The ice making apparatus includes an ice maker 210 for freezing ice, an ice bank 220 for storing ice from the ice maker 210, and discharging the ice, an ice moving device 230 for holding and moving ice from the ice bank 220 in an up/down direction, and a driving device 240 for moving the ice moving device 230.

It is preferable that the ice maker 210 and the ice bank 220 are arranged inside of the freezing chamber 110, for making the ice at the ice maker 210, and storing the ice in the ice bank 220 so that the ice is not melt.

It is preferable that the ice moving device 230 and the driving device 240 are built in a door or a sidewall of the body 100, for preventing infiltration of heat from the driving device to the freezing chamber 110, and taking out the ice easily.

Above units of the ice maker will be described in detail.

The ice maker 210 has a heater 212 for heating a surface of ice frozen at a freezing tray 211 slightly before discharging to the ice bank 220. The ice maker 210 also has a full ice detector 213 additionally for measuring a height of ice in the ice bank 220 to stop or start freezing of ice. The ice maker 210 is connected to an additional water supplying device (not shown).

The ice maker 210, the ice bank 220, the ice moving device 230, and the driving device 240 are connected to an additional control unit or a central control unit (hereinafter called as "control unit") of the body 100, electrically.

The ice bank 220 includes an ice storage case 221 under the ice maker 210, for receiving ice from the ice maker 210, and an ice conveyer 222 in the ice storage case 221 for discharging ice to the ice moving device 230.

The ice storage case 221 has a size of an ice storage capacity adequate for supplying ice to the user right away when the user desires. It is required that the ice storage case 221 has a size enough to supply ice to a ice moving case 231 described below at least three times, continuously. Therefore, it is preferable that the ice storage case 221 has a size greater than the ice moving case 231.

The ice conveyor 222 includes a conveyer motor 223 in the ice storage case 221, for generating driving force, and an ice conveyer 224 rotatably coupled to the conveyer motor 223 for pushing ice to the ice moving device 230 as it rotates.

The ice conveyer 224 has a helical blade fixedly secured to a rotating shaft.

The ice bank 220 is connected to a passage 130 in which the ice moving device 230 is arranged. It is preferable that the passage 130 is vertical direction. Also, the passage 130 is in the door, or a wall. For preventing cold air from leaking, it is preferable that the passage 130 is isolated from the freezing chamber 110 and the refrigerating chamber 120.

Moreover, it is preferable that there are position detectors 131, and 132 provided to the passage 130 for detecting a position of the ice moving device 230. According to this, if the ice moving device 230 reaches to the highest, or the lowest position, operation of the driving device can be stopped.

The ice moving device 230 includes the ice moving case 231 connected to the driving device 240 for receiving ice from the ice bank 220, and an ice discharger 232 in the ice moving case 231, for discharging ice from the ice moving case 231 to the dispenser 140.

A size of the ice moving case 231 fixes an amount of ice able to be dispensed to the dispenser 140.

The ice discharger 232 includes a discharger motor 233 in the ice moving case 231 for generating driving force, and an ice discharging part 234 rotatably coupled to the discharger motor 233 for discharging ice to the dispenser as it rotates.

The ice discharging part 234 has a helical blade fixedly secured to a rotating shaft.

It is preferable that the ice moving device 230 further includes an ice crusher 235 designed to be rotated by the ice discharging part 234 for crushing ice. The ice crusher 235 includes a plurality of cutters, for an example, fixed cutters, and rotating cutters.

The ice moving device 230 can dispense crushed, or non-crushed ice, selectively. For an example, the non-crushed ice can be dispensed as the ice crusher 235 is rotated slowly, and the crushed ice can be dispensed as the ice crusher 235 is rotated at a high speed.

Though not shown, the ice moving device 230 may only have the ice moving case 231 connected to the driving device 240, and designed to receive ice from the ice bank 220, and to be taken out of the dispenser in a lifted position. If such an ice moving device 230 is used, the user can scoop out the ice, personally.

In the meantime, the driving device 240 includes a motor 241 for generating driving force, a pulley 242 rotatable by the motor 241, and a wire 243 wound on the pulley and connected to the ice moving case 231.

The motor 241 may be mounted above or below the dispenser. It is preferable that the motor 241 is mounted above the dispenser for reducing a length of the wire 243 to the maximum.

Figure 2:
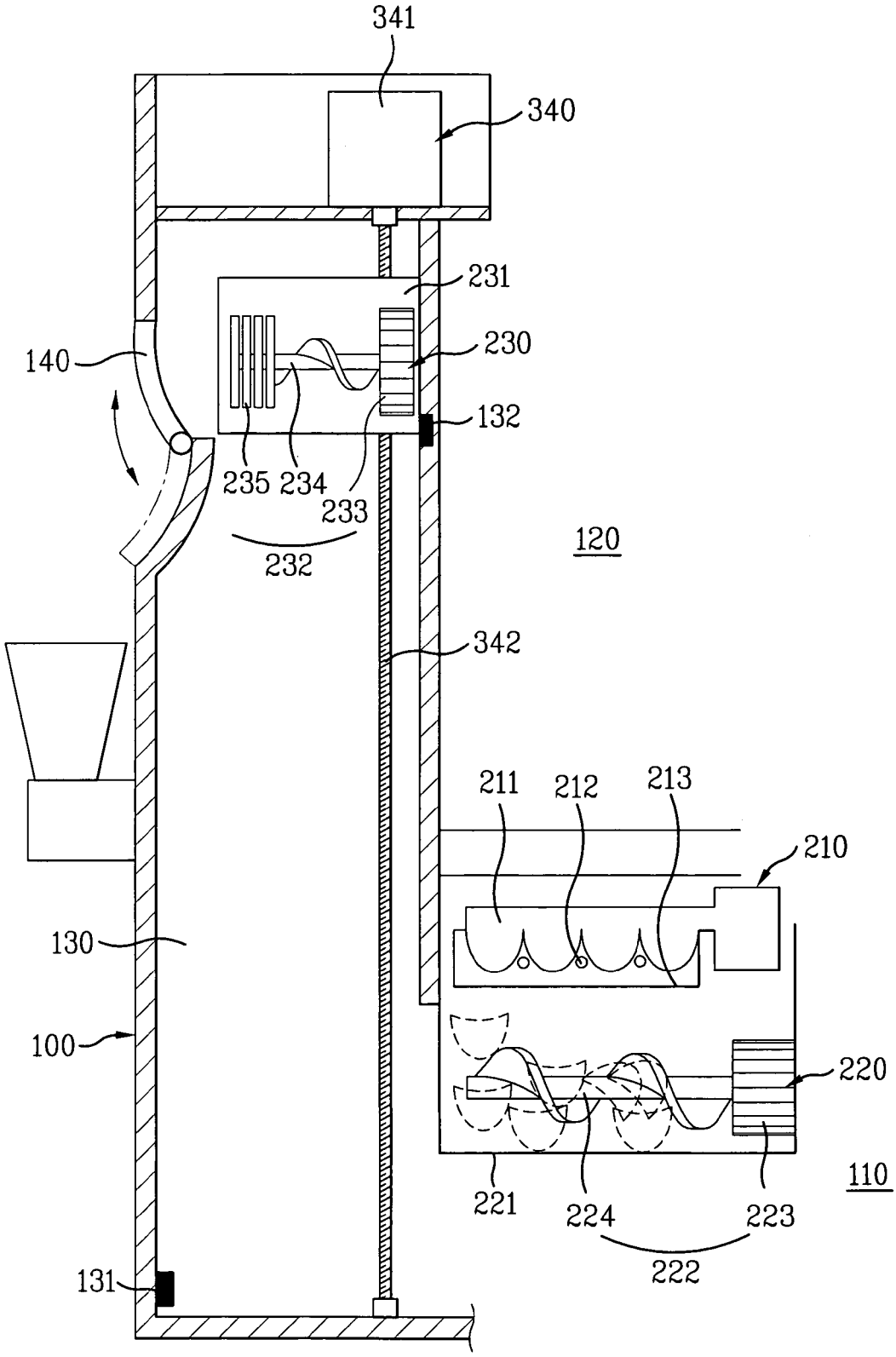
FIG. 2 illustrates a diagram of a variation of driving device in the refrigerator in FIG. 1, schematically.

Referring to FIG. 2, as the driving device 340, a ball screw design may be applied. The driving device 340 includes a motor 341 for generating driving force, and a ball screw 342 rotatably coupled to the motor, having a helical groove in an outside circumferential surface, for moving up/down the ice moving case as it rotates.

In this instance, the motor 341 may be mounted on an upper side or a lower side of the passage 130. FIG. 2 shows a case the motor 341 is mounted on the upper side.

Such a ball screw type driving device 340 has an advantage in that stable up/down movement of the ice moving device 230 can be made.

Moreover, it is apparent to a person skilled in the art that the driving device can be embodied in various forms, such as rack and pinion, ball screw, and so on. However, if the rack and pinion is applied to the driving device, the rack of a spur gear shape will be arranged on the passage 130 vertically, and the motor 241 will be arranged in a lifting case for moving with the lifting case.

Figure 3:
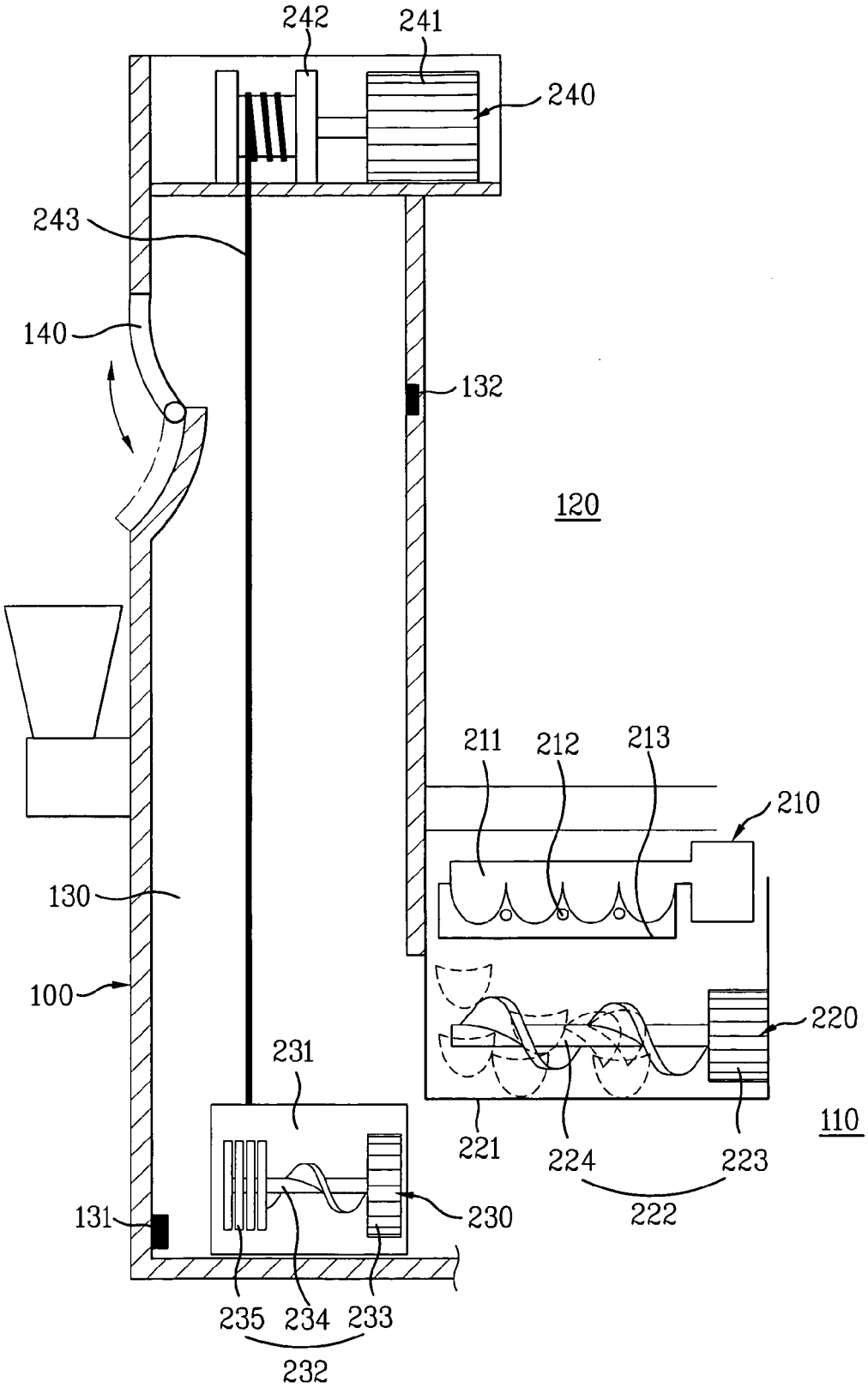
FIG. 3 illustrates a diagram showing a state in which ice is discharged from the ice maker in FIG. 1 to a ice storage portion, and the ice driving device is moved down.
Figure 4:
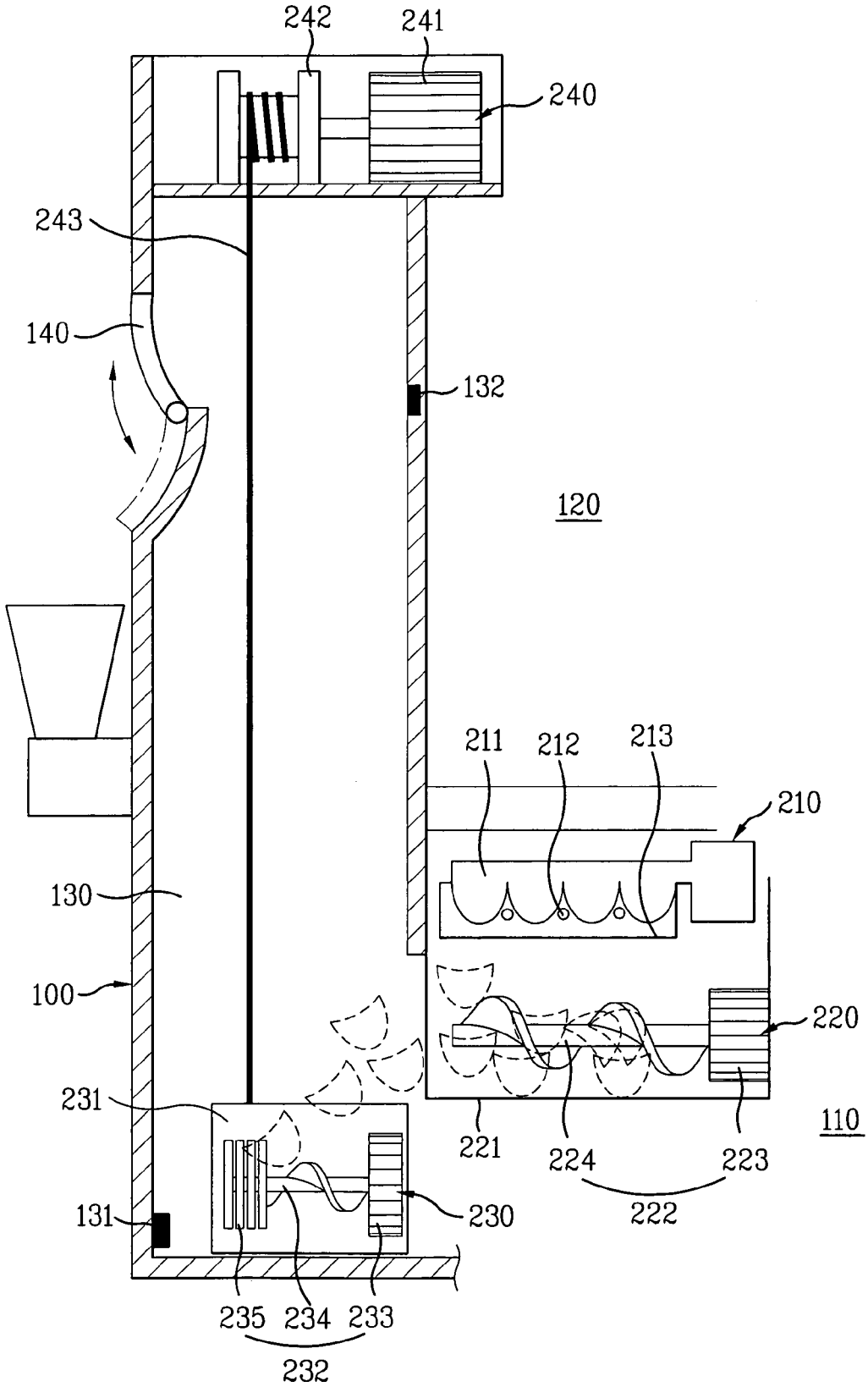
FIG. 4 illustrates a diagram showing a state ice is being discharged from the ice storage portion in FIG. 1 to the ice driving device.
Figure 5:
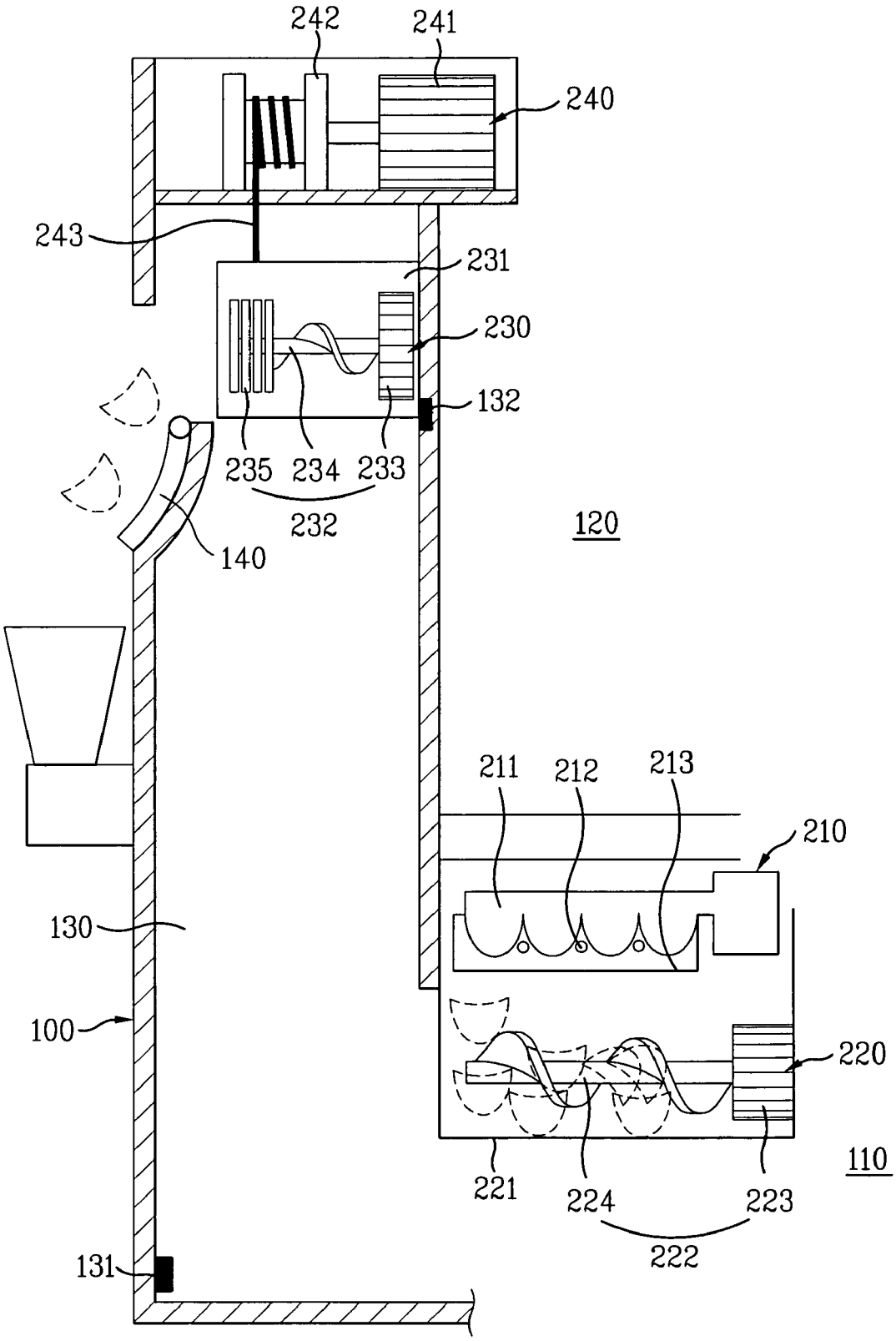
FIG. 5 illustrates a diagram showing a state the ice driving device is moved up and discharges ice to a dispenser.

The operation of the refrigerator having the ice making apparatus of the present invention applied thereto will be described with reference to FIGS. 3 to 5.

The control unit moves a full ice sensing arm in up/down direction, to measure an amount of ice in the ice storage case 221.

In this instance, if the control unit determines that there is shortage of ice, the control unit supplies water to the ice maker 210, and freezes the water. If it is determined that water in the ice maker 210 is frozen adequately, the control unit puts the heater 212 is the ice maker 210 into operation, to melt a surface of the ice in the freezing tray 211 slightly, and discharges the ice to the ice storage case 221.

While repeating above processes for a predetermined times, the ice is stored in the ice storage case 221. If the control unit determines that an adequate amount of ice is stored in the ice storage case 221, the control unit stops freezing ice at the ice maker 210.

In the meantime, if the user presses an ice dispensing button, the conveyer motor 223 in the ice bank 220 comes into operation. In this instance, as the ice conveyer 224 rotates, the ice is discharged from the ice storage case 221 to the ice moving case 231 as shown in FIG. 4.

Then, when the motor 241 is put into operation, the pulley 242 rotates. As the wire 243 is wound on the pulley 242, the ice moving device 230 is lifted.

The position detecting sensors 131, and 132 provide information on a position of the ice moving device 230 to the control unit. If the control unit determines that the ice moving device 230 is moved up to the maximum as shown in FIG. 5, the control unit stops the driving device.

Then, the discharger motor 233 is put into operation, to rotate the ice discharging part 234. If the discharger motor 233 rotates at a high speed, the ice crusher 235 crushes before discharging the ice to the dispenser. Or, if the discharger motor 233 rotates at a low speed, the ice crusher 235 discharges non-crushed ice to the dispenser.

In the meantime, the ice maker of the present invention is applicable to a product with a low body 100 height, such as a water purifier. In a case the ice maker is applied to the product with a low body height, the ice can be dispensed from an upper side of the body 100 even if the body 100 has a low height.

The refrigerator of the present invention has the following advantages.

The refrigerator of the present invention permits the user to obtain ice without bending oneself because the ice frozen at a lower portion thereof can be lifted to an upper side.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A refrigerator comprising:

an ice maker;

an ice bank for receiving ice from the ice maker, and discharging the ice therefrom;

an ice moving device including an ice moving case movably mounted for receiving ice from the ice bank, and an ice discharger in the ice moving case for discharging from the ice moving case to a dispenser and for crushing ice in the ice moving case; and a driving device for moving the ice moving device.

2. The refrigerator as claimed in claim 1, wherein the ice maker is arranged at a lower portion of a refrigerator body.

3. The refrigerator as claimed in claim 1, wherein the refrigerator body has a freezing chamber at the lower portion, and the ice maker is arranged at the freezing chamber.

4. The refrigerator as claimed in claim 3, wherein the ice bank is arranged at the freezing chamber.

5. The refrigerator as claimed in claim 1, wherein the ice bank includes:

an ice storage case under the ice maker for receiving ice from the ice maker; and an ice conveyer in the ice storage case for discharging ice to the ice moving device.

6. The refrigerator as claimed in claim 5, wherein the ice conveyer includes:

a conveyer motor in the ice storage case for generating driving force; and an ice conveying part rotatably coupled to the conveyer motor for pushing the ice to the ice moving device as the ice conveying part rotates.

7. The refrigerator as claimed in 1, wherein the ice discharger includes:

a discharger motor in the ice moving case for generating driving force; and an ice discharging part rotatably coupled to the discharger motor for discharging ice to the dispenser as the ice discharging part rotates.

8. The refrigerator as claimed in claim 7, further comprising an ice crusher for crushing ice as the ice crusher is rotated by the ice discharger.

9. The refrigerator as claimed in claim 1, wherein the ice moving device is a ice moving case connected to the driving device, and designed to receive ice from the ice bank, and to be taken out of the dispenser in a predetermined position.

10. The refrigerator as claimed in claim 1, wherein the ice bank has a ice storage capacity greater than the ice moving device.

11. The refrigerator as claimed in claim 1, further comprising a passage for moving the ice moving device.

12. The refrigerator as claimed in claim 1, wherein the driving device includes:

a motor for generating driving force;

a pulley rotatable by the motor; and a wire wound on the pulley and connected to the ice moving device.

13. The refrigerator as claimed in claim 1, wherein the driving device includes:

motor for generating driving force; and a ball screw rotatably coupled to the motor, for moving the ice moving device as the ball screw rotates.

14. The refrigerator as claimed in claim 13, wherein the motor is arranged above the dispenser.

15. A refrigerator comprising:

an ice maker at a lower portion of a refrigerator body, for freezing ice;

an ice bank including an ice storage case under the ice maker for receiving ice from the ice maker, and an ice conveyer in the ice storage case for discharging ice therefrom;

an ice moving device including a ice moving case movably mounted for receiving ice from the ice bank, and an ice discharger in the ice moving case, for discharging ice from the ice moving case to dispenser and for crushing ice in the ice moving case; and a driving device for moving up/down the ice moving device.

16. The refrigerator as claimed in claim 15, wherein the refrigerator body includes:

a freezing chamber at a lower portion thereof where the ice maker is mounted.

* * * * *